United States Patent [19]

Arai et al.

[11] Patent Number: 4,778,357

[45] Date of Patent: Oct. 18, 1988

[54] SHUT-OFF VALVE FOR AN ELECTROMAGNETIC PUMP

[75] Inventors: Takatoshi Arai; Michio Idei, both of Saitama, Japan

[73] Assignee: Jidosha Kiki Co., Ltd., Tokyo, Japan

[21] Appl. No.: 87,952

[22] Filed: Aug. 13, 1987

Related U.S. Application Data

[63] Continuation of Ser. No. 782,292, Sep. 30, 1985, abandoned.

[30] Foreign Application Priority Data

Oct. 15, 1984 [JP] Japan ..... 59-154320[U]

[51] Int. Cl.[4] ..... F04B 17/04

[52] U.S. Cl. ..... 417/417; 417/441; 417/552

[58] Field of Search ..... 417/416, 417, 440, 441, 417/444, 552

[56] References Cited

U.S. PATENT DOCUMENTS 2,474,349 6/1949 Dickey et al. ..... 417/417
4,376,618 3/1983 Toyoda et al. ..... 417/417

FOREIGN PATENT DOCUMENTS 57-213 1/1982 Japan .
57-47438 10/1982 Japan .

*Primary Examiner*—Carlton R. Croyle
*Assistant Examiner*—Theodore Olds
*Attorney, Agent, or Firm*—Blakley, Sokoloff, Taylor & Zafman

[57] ABSTRACT

In an electromagnetic pump, the inner end of an outlet pipe fixed in a pump housing extends for a predetermined length inside a sleeve housing a plunger to form a pump delivery pulsation absorption chamber around the outlet pipe. The inner end opening of this pipe is selectively closed by a control valve serving as a guide member for slidably guiding a valve body of a delivery valve along the axial direction. The fuel leakage prevention control valve and the pulsation absorption chamber are simply and optimally formed with a single construction.

6 Claims, 3 Drawing Sheets

SHUT-OFF VALVE FOR AN ELECTROMAGNETIC PUMP

This is a continuation of application Ser. No. 782,292, filed Sept. 30, 1985, now abandoned.

BACKGROUND OF THE INVENTION

The present invention relates to an improvement in an electromagnetic pump of a type used for fuel supply in a vehicle.

Vehicles commonly turn over or fall sideways by collision or for other reasons due to the recent increase in traffic volume. In such a traffic accident, fuel often leaks from a fuel tank, causing fire and resulting in fatalities. For this reason, demand has arisen for minimizing risk of fuel leaks in an emergency and preventing vehicle fire. For this purpose, first type of conventional electromagnetic valves are proposed in Japanese Utility Model Publication Nos. 57-213 and 57-47438. In one conventional electromagnetic valve, a control valve body constituting a control valve is arranged to close an opening of a through hole serving as a flow path. The control valve body is arranged at the outlet port of a sleeve member for slidably supporting a plunger or at the end of the through hole of the plunger. In another conventional electromagnetic valve, a control valve body for closing an outlet opening of a sleeve member is formed integrally with a delivery valve disposed at an opening of a through hole of a plunger.

In order to improve pumping performance in conventional electromagnetic pumps of this type, pulsation caused by reciprocal movement of the plunger must be prevented. In a conventional electromagnetic pump having a cyindrical shape, suction and delivery pressure chambers are formed at the two ends of a cylindrical pump housing, and a damper chamber is formed by partitioning the inner space by a diaphragm or the like. The pulsation then is absorbed by the damper chamber.

In the first type conventional electromagnetic valves each with a control valve for fuel leakage prevention having the structure described above, the control valve is mounted at a position different from the mounting position of the delivery valve required therefor. The overall structure of the control valve is complicated, and the number of constituting members is increased. As a result, the electromagnetic valve and hence the pump as a whole have a large size.

In the second type conventional electromagnetic valve, the control valve is mounted integrally with the delivery valve. Although the number of constituting members can be decreased, the delivery valve receives a high resistance due to the fluid pressure and its own weight, so that opening/closing of the delivery valve is delayed and a suction pressure or delivery quantity is decreased, resulting in inconvenience. Furthermore, a biasing force of a return spring for reciprocating the plunger acts on the delivery valve, so that the fitting and seat surfaces of the valve are worn, thus presenting a valve function problem.

In the electromagnetic pumps described above, a pulsation absorption function for absorbing pulsation at the delivery side upon reciprocal movement of the plunger to take fuel in or to deliver it to the delivery side must be provided in addition to a fuel leakage prevention function in an emergency. However, conventional structures are complicated and result in large pumps of high cost. Not only operation of a carburetor float valve and various relief valves is interfered, but also noise tends to be produced. Optimal suction and delivery operations of the pump cannot therefore be expected. The adverse influence of pulsation typically occurs in a rectangular pump without a pulsation absorption chamber.

An electromagnetic pump of this type is recently mounted in a small car with a stroke volume of 1,000 cc or less. A compact, lightweight, low-cost pump is required which satisfies fuel leakage prevention and pulsation absorption needs as described above. However, no conventional electromagnetic valve can currently satisfy these requirements.

SUMMARY OF THE INVENTION

It is, therefore, a principal object of the present invention to provide a simple electromagnetic pump which has fuel leakage prevention and pulsation absorption functions to improve pumping performance.

It is another object of the present invention to provide an electromagnetic pump wherein constituting components can be easily molded and tooled, assembly can be simplified, and operation reliability is improved.

It is still another object of the present invention to provide a compact, lightweight, low-cost electromagnetic pump.

In order to achieve the above objects of the present invention, there is provided an electromagnetic pump comprising: a cup-like housing body having an outlet cylindrical portion at a center thereof; a lid member having an inlet cylindrical portion at a center thereof and fixed to the housing body to constitute a pump housing; a nonmagnetic sleeve member extending between the outlet and inlet cylindrical portions; a magnetic plunger slidably fitted in the nonmagnetic sleeve member and having a central through hole; a return spring, arranged between the inlet cylindrical portion and part of the central through hole, for biasing the plunger toward a delivery side; inlet and outlet pipes extending through the inlet and outlet cylindrical portions, respectively; means for preventing fuel from leaking outside a fuel system, the fuel leakage preventing means being provided with a delivery valve body disposed at an outlet end of the magnetic plunger and slidable along an axial direction of the magnetic plunger, a ring-like member for slidably guiding the delivery valve body and preventing fuel leakage from the fuel system, and a valve seat having an outlet surface contacting an inner end of the outlet pipe and an inlet surface contacting an outlet surface of the ring-like member; and electromagnetic means for driving the magnetic plunger; wherein the inner end of the outlet pipe extends for a predetermined length inside the nonmagnetic sleeve member for housing the magnetic plunger to form a pulsation absorption chamber around the outlet pipe, and an opening of the inner end of the outlet pipe is selectively closed by the fuel leakage preventing means.

According to the present invention, an inner end of a pipe mounted at an outlet port of a pump housing extends inside a sleeve member for a predetermined length to form an annular space as a pulsation absorption chamber around the pipe. At the same time, a valve body of a delivery valve disposed at the end of the outlet port of the plunger is slidably supported along the axial direction with respect to a fuel leakage prevention control valve, thereby achieving proper valve operation.

DESCRIPTION OF THE PREFERRED EMBODIMENT

The present invention will be described with reference to a preferred embodiment in conjunction with the accompanying drawings.

Figure 1:
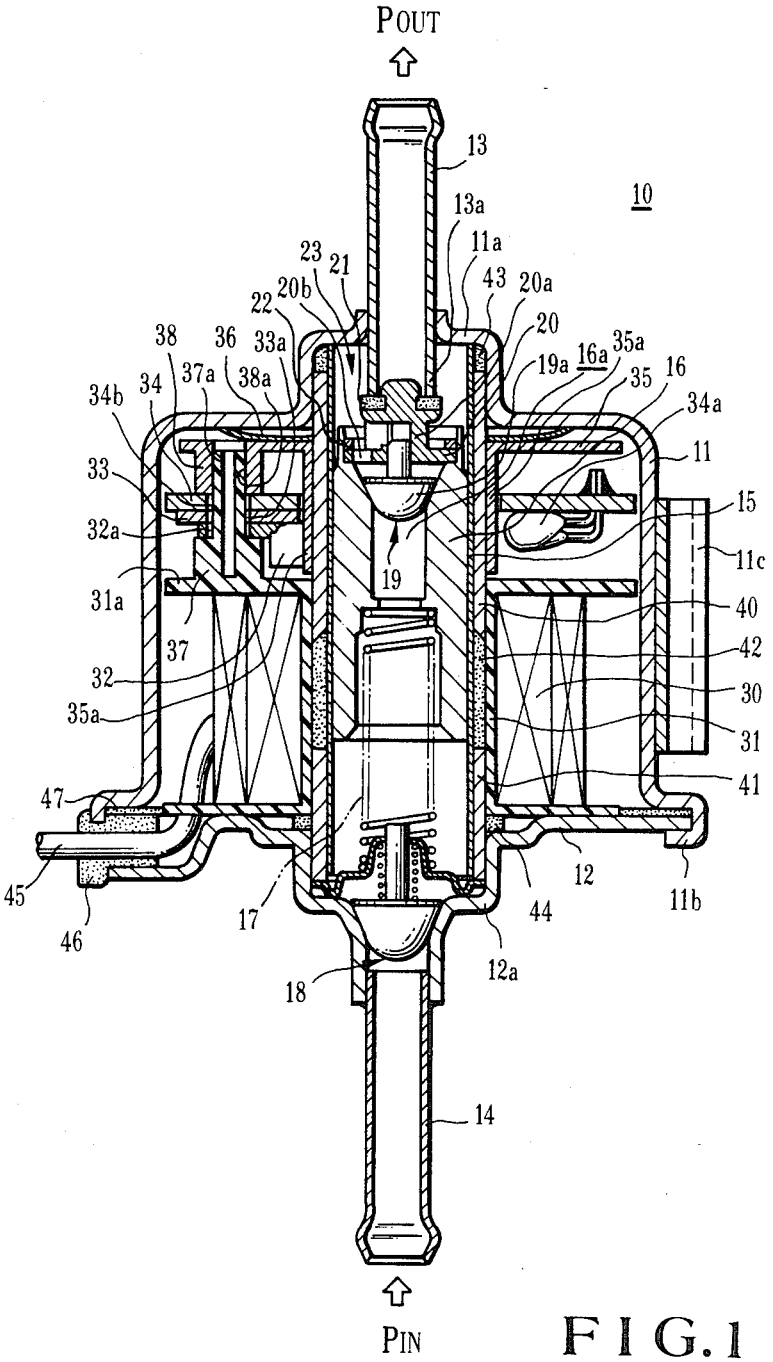
FIG. 1 is a longitudinal sectional view of an electromagnetic pump according to an embodiment of the present invention.
Figure 2:
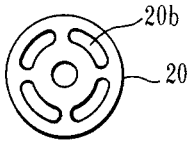
FIG. 2 is a plan view of a fuel leakage prevention control valve member 20 in the electromagnetic pump of FIG. 1 viewed from the fuel supply side.
Figure 3:
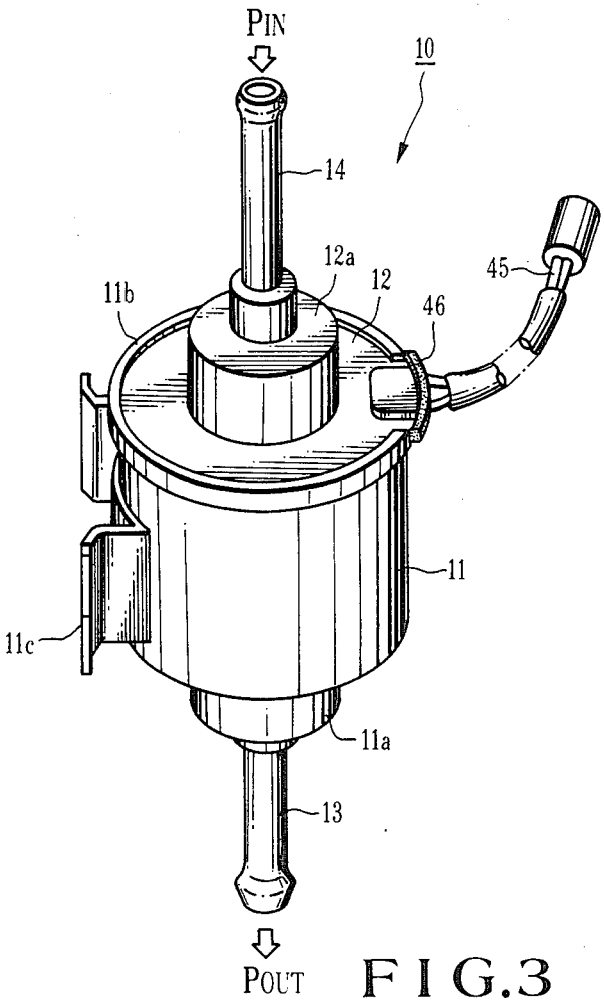
FIG. 3 is a perspective view of the electromagnetic pump shown in FIG. 1.
Figure 4:
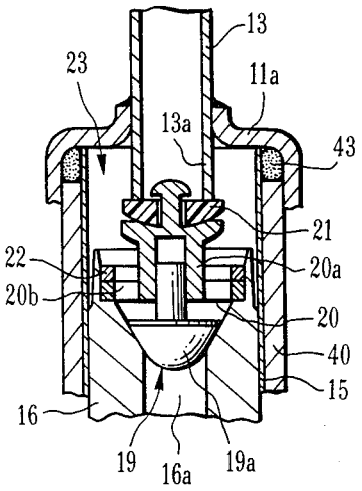
FIGS. 4 to 7 are respectively longitudinal sectional views showing modifications of the delivery valve assembly as the main part of the electromagnetic pump of FIG. 1.
Figure 5:
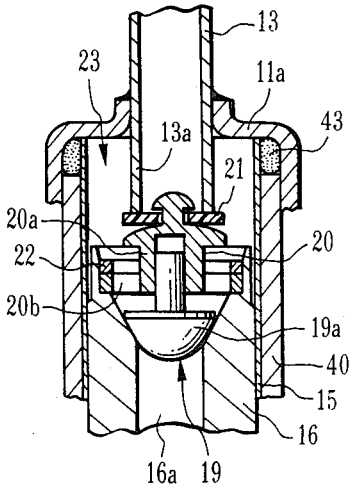
Figure 6:
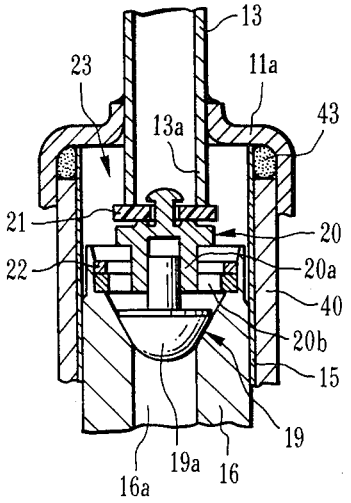
Figure 7:
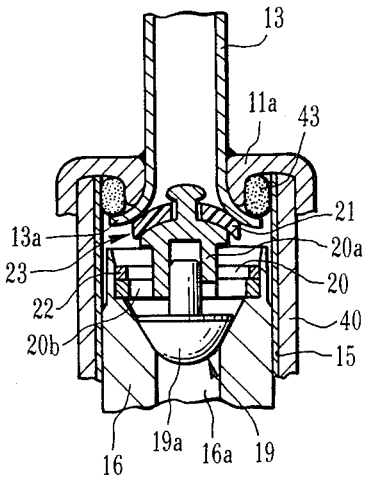

FIGS. 1 to 3 show an electromagnetic pump according to an embodiment of the present invention. An electromagnetic pump 10 has a cup-like housing body 11 and a disk-like lid 12 for closing the opening of the housing body 11. The body 11 and the lid 12 constitute a pump housing. Cylindrical portions 11*a* and 12*a* are formed integrally with the central portion of the bottom (upper side in FIG. 1) and the central portion of the lid 12, respectively. Pipes 13 and 14 constituting fluid outlet and inlet ports are brazed at the centers of the cylindrical portions 11*a* and 12*a*. The body 11 and the lid 12 can be easily tooled by pressing metal plates. An edge 11*b* defining the opening of the body 11 is caulked to the lid 12, as shown in FIG. 3. The body 11 and the lid 12 of the pump housing also serve as a yoke for forming a magnetic path from an excitation coil (to be described later). An inner space defined by the body 11 and the lid 12 houses mechanical and electrical components of the pump. As shown in FIG. 3, a bracket 11*c* is used to mount the electromagnetic pump 10 to the vehicle body.

A nonmagnetic sleeve member 15 is inserted between the cylindrical portion 11*a* of the body 11 and the cylindrical portion 12*a* of the lid 12. A magnetic plunger 16 with a through hole 16*a* is slidably inserted in the sleeve member 15 and is always biased by a return spring 17 arranged at the inlet port side toward the outlet port of the housing. The spring 17 is mounted at the end of the inlet port of the housing. Reference numeral 18 denotes a suction valve mounted at the inlet end of the sleeve member 15; and 19, a delivery valve mounted at the outlet end of the plunger 16.

With the above arrangement, an inner end 13*a* of the pipe 13 mounted at an outlet port of the pump housing extends for a predetermined length inside the sleeve member 15 surrounding the plunger 16, forming a pulsation absorption chamber 23 around the pipe. At the same time, the opening of the inner end 13*a* is selectively closed by a ring-like guide member 20 for slidably supporting a valve body 19*a* of the delivery valve 19 disposed at the outlet end of the plunger 16. The member 20 also serves as a constituting member of a fuel leakage prevention control valve.

More specifically, the valve body 19*a* of the delivery valve 19 is slidably supported in a central cylindrical portion 20*a* of the member 20 constituting the fuel leakage prevention control valve fixed integrally with the end of the plunger 16. The member 20 has a function of guiding the valve body 19*a* of the delivery valve 19. A rubber or plastic valve seat 21 is disposed at the outer end of the cylindrical portion 20*a* to selectively close the inner end of the pipe 13 which extends inside the sleeve member 15 from the outlet port side for a predetermined length. A stopper ring 22 is disposed to fix the member 20 to the end of the plunger 16. As shown in FIG. 2 in detail, the member 20 has four arcuated holes 20*b* to allow fluid to pass therethrough. The holes 20*b* are formed in a peripheral portion of the member 20 at equal angular intervals.

The fuel leakage prevention control valve is moved together with the plunger 16 in the sleeve member 15. When the electromagnetic pump is not operated, the control valve closes the inner end 13*a* of the pipe 13 by the biasing force of the return spring 17, thereby properly preventing fluid from leaking to the outlet port and hence providing a practical effect (i.e., guaranteeing safety of the driver and passengers in a vehicle).

According to the present invention, in order to form the control valve, the inner end 13*a* of the delivery pipe 13 extends inside the sleeve member 15 for a predetermined length to form an annular space serving as the pulsation absorption chamber 23 around the pipe 13. Although the delivery port structure is simple, pulsation caused by fuel can be properly absorbed, resulting in convenience.

Other components of the electromagnetic pump 10 will be described hereinafter. A plastic coil bobbin 31 having an excitation coil 30 therearound is arranged around the sleeve member 15 housing the plunger 16. A transistor 32 and a heat sink 33 are integrally arranged to be spaced apart from one outer surface portion (upper side in FIG. 1) of a flange 31*a*. The transistor 32 partially constitute an oscillator for flowing a current to the excitation coil 30. A printed circuit board 34 and a holder 35 are spaced apart from each other by a predetermined distance along a direction perpendicular to the surface of the heat sink 33. The printed circuit board 34 has various electronic elements 34*a* such as a resistor and a diode which constitute the oscillator together with the transistor. The stacked assembly of components making up the pump is housed in the body 11 constituting the pump housing such that the front end of the stacked assembly is located at the holder 35 side in the body 11. The assembly is elastically supported in the body 11 by a leaf spring 36 inserted at the bottom of the body 11.

With this arrangement, the assembly of the transistor 32 and the printed circuit board 34 can be simplified, and electronic elements on the printed circuit board 34 will not be short-circuited.

A plurality of studs 37 extend on one outer surface of the the flange 31*a* of the coil bobbin 31 to support the transistor 32 and the heat sink 33 as well as the printed circuit board 34 at a predetermined distance from the above-mentioned one surface of the flange 31*a*. A plurality of studs 38 extend on the inner side surface of the holder 36 to oppose the studs 37. Reference numeral 37*a* denotes a front small-diameter portion of the stud 37. The small-diameter portion 37*a* is inserted into holes 32*a*, 33*a* and 34*b* which are respectively formed in the transistor 32, the heat sink 33 and the printed circuit board 34 to inhibit their movement along the radial direction of the pump. Furthermore, each small-diameter portion 37*a* is inserted in a hole 38*a* formed in the corresponding stud 38 at the side of the holder 35, thereby forming the assembly as an integral body. Reference numeral 35*a* denotes a cylindrical portion for holding the sleeve member 15 formed at the central portion of the holder 35. In this embodiment, the printed circuit board 34 and the holder 35 have substantially a ring-like shape which matches with the coil bobbin 31. The heat sink 33 has a sector-shaped member of size sufficient to allow mounting of the transistor 32 on the printed circuit board 34.

Rotation of the stacked assembly including the coil bobbin 31 housed in the pump housing is prevented by utilizing a frictional force between the adjacent members or by providing an anti-rotational engaging member between the coil bobbin 31 and the lid 12. With this arrangement, the heat sink 33 can be brought into contact with the inner wall of the body 11 so as to allow proper heat radiation of the transistor 32.

A pair of magnetic cylinders 40 and 41 are arranged along the axial direction to form a magnetic path from the excitation coil 30. The magnetic cylinders 40 and 41 are sandwiched between the outer surface of the sleeve member 15 housing the plunger 16 and the inner surface of the coil bobbin 31 having the excitation coil wound therearound. The magnetic cylinders 40 and 41 comprise coiled bushes or split sleeves obtained by curving a plate material, thereby simplifying tooling and assembly. Seal members 42, 43 and 44 are properly inserted between the inner path of the sleeve member 15 and the inner space of the pump housing to block fuel, so that a complete seal can be obtained.

Reference numeral 45 denotes a lead wire of the printed circuit board 34 which is led from part of a joint portion between the body 11 and the lid 12 through a grommet 46; and 47, a gasket for sealing a gap between the body 11 and the lid 12. Other arrangements and operations of the electromagnetic pump 10 are known to those skilled in the art, and a detailed description thereof will be omitted.

The present invention is not limited to the particular embodiment described above. The shape and structure of the pump can be suitably changed and modified.

In the above embodiment, the ring-like member 20 constituting the fuel leakage prevention control valve for supporting the valve body 19*a* of the delivery valve 19 is fixed at the outlet end of the portion 20*a* by the rubber or plastic valve seat 21 for selectively opening the inner end 13*a* of the pipe 13. However, the present invention is not limited to this. FIGS. 4 to 7 show modifications of the main part of the electromagnetic pump, respectively. In the modification shown in FIG. 4, a cylindrical portion 20*a* of a ring-like member 20 which is located at the outlet port side has an arcuated surface inclined downward toward its center. The member 20 swingably supports a valve seat 21 which has an inclined surface brought into contact with its arcuated surface. The surface of the seat 2 which is located opposite to the inclined surface thereof is a flat surface contacting a pipe 13. In the modification shown in FIG. 5, a surface of a ring-like member 20 which is located at the outlet port side has an arcuated surface inclined downward its edge. The member 20 swingably supports a valve seat 21 having one surface which is flat and in partial contact with the arcuated surface of the member 20. The other surface of the valve seat 21 which contacts a pipe 13 is also a flat surface. In the modification shown in FIG. 6, a surface of a ring-like member 20 which is located at the outlet port side has an annular projection. The annular projection is in contact with one flat surface of a valve seat 21. The other surface of the valve seat 21 which contacts a pipe 13 is also a flat surface. In the modification shown in FIG. 7, a surface of a ring-like member 20 which is located at the outlet port side is substantially the same as that of FIG. 5. However, an inner end 13*a* of a pipe 13 is flared. The inner surface of the flared portion of the pipe 13 is in contact with an arcuated valve seat 21 whose inner surface is in contact with the arcuated surface of the member 20. In this modification, an inner edge of a cylindrical portion 11*a* is curved inward to follow the outer surface of the flared portion of the pipe 13. The seal material is filled in a space defined by the curved edge of the portion 11*a* and a sleeve member 15. In each modification, since the valve seat 21 can be swingably supported by the member 20, a perpendicular alignment error between the inner end 13*a* and the valve seat 21 upon inclination of the pipe 13 or the seat 21 can be absorbed.

In the structure of FIG. 1, an elastic member must be used for the valve seat 21 to absorb the perpendicular alignment error. In the modifications of FIGS. 4 to 7, the valve seat 21 need not have a high elasticity so as to obtain sufficient seal and can comprise a plastic or metal material. An anti-gasoline rubber such as Biton can be used to achieve an inexpensive structure. By adapting one of the modifications, an allowable inclination range of the pipe 13 and the seat 21 can be increased, and high-precision tooling and assembly are not required, thus decreasing the manufacturing cost.

According to the electromagnetic pump as described above, the inner end of the outlet pipe fixed in the pump housing extends for a predetermined length inside the sleeve housing the plunger to form the pump delivery pulsation absorption chamber around the outlet pipe. At the same time, the inner end opening of this pipe is selectively closed by the control valve serving as the guide member for slidably guiding the valve body of the delivery valve along the axial direction. The fuel leakage prevention control valve and the pulsation absorption chamber are simply and optimally formed with a single construction. Furthermore, tooling and assembly of the constituting members can be greatly simplified, and the manufacturing cost can be greatly decreased. At the same time, noiseless pumping can be performed. With the arrangement described above, the extending length of the outlet pipe inside the sleeve member is properly changed to vary a magnetic gap between the plunger and the magnetic cylinder. Without changing dimensions of the respective constituting members, delivery quantity and start voltage can be changed, thereby satisfying various application needs.

What is claimed is:

1. An electromagnetic pump for fuel comprising:

a cup-like housing body having an outlet cylindrical portion at a center thereof;

a lid member having an inlet cylindrical portion at a center thereof and fixed to said housing body to constitute a pump housing;

a nonmagnetic sleeve member extending between said outlet and inlet cylindrical portions;

a magnetic plunger slideably fitted in said nonmagnetic sleeve member and having a central thorugh hole;

a return spring, arranged between said inlet cylindrical portion and part of said central through hole, for biasing said plunger toward a delivery side;

inlet and outlet pipes extending through said inlet and outlet cylindrical portions, respectively;

a delivery valve body disposed at an outlet end of said central through hole of said magnetic plunger and slidable along an axial direction of said magnetic plunger so as to selectively prevent flow of the fuel through said central through hole;

a ring-like member retained at an outlet end of said magnetic plunger having a peripheral portion and a central portion, said central portion having an inlet end and an outlet surface, said inlet end of said central portion having means for slideably guiding said delivery valve body, said peripheral portion having an aperture therethrough to permit the fuel to flow from said outlet end of said central through hole of said magnetic plunger;

a valve seat having an inner peripheral portion and an outer peripheral portion, said inner peripheral portion being axially retained on said central portion of said ring-like member, said outer peripheral portion being free to pivot, said valve seat having an outlet surface contacting an inner end of said outlet pipe and an inlet surface contacting said outlet surface of said ring-like member; and electromagnetic means for driving said magnetic plunger;

wherein said inner end of said outlet pipe extends for a predetermined length inside said nonmagnetic sleeve member for housing said magnetic plunger to form a pulsation absorption chamber around said oulet pipe, and an opening of said inner end of said outlet pipe is selectively closed by said valve seat.

2. A pump according to claim 1, wherein said outlet surface of said ring-like member comprises an arcuated surface inclined toward a center thereof, said inlet surface of said valve seat comprises a surface corresponding to said outlet surface of said ring-like member, and said outlet surface of said valve seat comprises a flat surface.

3. A pump according to claim 1, wherein said outlet surface of said ring-like member comprises an arcuated surface inclined toward an edge thereof, said inlet and outlet surfaces of said valve seat comprise flat surfaces, respectively.

4. A pump according to claim 1, wherein said outlet surface of said ring-like member comprises a flat surface with an annular projection, and said inlet and outlet surfaces of said valve seat comprise flat surfaces, respectively.

5. A pump according to claim 1, wherein said outlet surface of said ring-like member comprises an arcuated surface inclined toward an edge thereof, and said inlet and outlet surfaces of said valve seat comprise arcuated surfaces so as to constitute an arcuated shape corresponding to that of said outlet surface of said ring-like member.

6. A pump according to claim 5, wherein said outlet pipe is flared at said inner end, so that said outlet surface of said valve seat is brought into contact with an inner wall surface of a flared portion of said outlet pipe.

* * * * *